US005392583A

United States Patent [19]

Gregory

[11] Patent Number: 5,392,583

[45] Date of Patent: Feb. 28, 1995

[54] METHOD OF RESTORING STANDING SEAM AND LIKE LAPPED METAL ROOFS CONSISTING OF SIDE-BY-SIDE PANELS HAVING SIDE EDGES WHICH OVERLAP

[75] Inventor: David B. Gregory, Kawkawlin, Mich.

[73] Assignee: Gregory Construction Company, Bay City, Mich.

[21] Appl. No.: 61,485

[22] Filed: May 13, 1993

[51] Int. Cl.[6] ..... E04D 3/366

[52] U.S. Cl. ..... 52/741.1; 52/408; 52/409; 52/537; 52/741.4; 52/746; 52/411

[58] Field of Search ..... 52/408, 409, 516, 537, 52/741.1, 741.4, 746, 411, 514

[56] References Cited

U.S. PATENT DOCUMENTS

| | | | |
|---|---|---|---|
| 4,099,357 | 7/1978 | Lester | 52/537 |
| 4,535,581 | 8/1985 | Fujiki et al. | 52/746 |
| 4,619,100 | 10/1986 | Emblin | 52/409 |
| 4,668,325 | 5/1987 | Brady et al. | 52/746 |
| 4,718,211 | 1/1988 | Russell et al. | 52/746 |
| 4,783,942 | 11/1988 | Nunley et al. | 52/741.4 |
| 4,860,514 | 8/1989 | Kelly | 52/746 |
| 4,932,171 | 6/1990 | Bettie | 52/746 |
| 4,981,762 | 1/1991 | Athey, Jr. | 52/408 |
| 5,031,374 | 7/1991 | Batch et al. | 52/408 |

OTHER PUBLICATIONS

Truco Inc. Roofing Systems "Project Solution". Dates of publication unknown but prior to the present invention.

Truco, Inc. "Eterna-Seal Rubber System for Metal Roofs". Dates of publication unknown but prior to the present invention.

Insulating Coatings Corporation "Step by Step Astec Ceramic Roofing System". Dates of publication unknown but prior to the present invention.

Adco Products, Inc. subsidary of Nalco Chemical Company "Techinical Information". Dates of publication unknown but prior to the present invention.

*Primary Examiner*—Carl D. Friedman
*Assistant Examiner*—Wynn E. Wood
*Attorney, Agent, or Firm*—Learman & McCulloch

[57] ABSTRACT

A method of restoring lapped metal roofs of, for example, steel or aluminum, and consisting of side-by-side panels having side and end edges which overlap to form edge joints, wherein the terminal edge of one panel is an exposed edge which extends over and overlies the edge of an adjacent panel to form an elongated joint, and wherein fasteners extend through the lapped panels to secure the panels together and in place. The method involves applying a flexible, formable rubber to cover the exposed terminal edges of the panels along their lengths. The rubber strips adhere to the panels and are stretchable with temperature-induced expansion and contraction of the panels. Similar strips are applied over all exposed fasteners, and then a substantially non-elastic asphaltic coating is applied over the strips and roof panels to bond to each. With temperature-induced relative movement of the roof panels, the coating cracks and separates and moves with the elastic strips as they stretch. It is returned by the rubber strip to substantially original position with return of the panel edges.

9 Claims, 2 Drawing Sheets

METHOD OF RESTORING STANDING SEAM AND LIKE LAPPED METAL ROOFS CONSISTING OF SIDE-BY-SIDE PANELS HAVING SIDE EDGES WHICH OVERLAP

BACKGROUND OF THE INVENTION

This invention relates to metal roof restoration and more particularly to a leak prevention system which will add years to the life of a metal panel roof.

In the past, metal roofs such as standing seam roofs have been restored by the assignee of the present applicant by wire brushing the roof to remove rust and residue, testing and replacing fasteners with oversize fasteners, washing and forced air-drying the roof, adhesively applying a fiberglass cloth product over exposed fasteners and along lapped edge joints, and applying an asphaltic overcoat to the roof after a priming coat.

Because metal roof panels in many areas are exposed to large temperature differentials, i.e., 70° F. in the state of Florida on some days, there is a considerable growth and contraction of the metal panels and the lapped edges move substantially relative to the relatively non-expansible fiberglass cloth strips covering them and tend to displace the strips. In addition to the expansion and contraction of the roof panels, wide temperature differentials create relative movement in the wood and metal structures which make up the underlying roof so that movement of the parts of the structure, in addition to the movement of the roof panels is involved. This cumulative movement frequently causes the asphaltic outer coating to pop-up, bubble, and split, and remain so damaged.

This prior art system involves removal of all debris, gravel, loose rust, and scaled previous coating, the repair of cracks, breaks, and open seams with an aluminum plastic cement, and the application of a butyl adhesive to adhere the fiberglass fabric over the joints, prior to application of an aluminum asphaltic roof coating.

Other prior art systems have utilized relatively expensive elastomeric coverings or coatings for the entire roof.

SUMMARY OF THE INVENTION

The present invention differs from the prior art method first mentioned in applying a flexible, formable polymer rubber strip or tape to bridge the exposed terminal edges of the lapped panels along their lengths. The strip is stretchable with temperature-induced movement of the panels and the asphaltic coating, later applied over the roof panels and the strip to bond to each, then parts or cracks and separates as required with stretching of the elastic rubber to which it bonds. Then, with return of the panels and roof structure elements, the asphaltic roofing coating is returned by the rubber to a condition of abutment or near abutment.

One of the prime objects of the invention is to design a system wherein an elastic rubber strip material, which adheres to the lapped edges of adjoining metallic roof panels, moves with the panels, and with movement of the underlying structure, and stretches as required.

An important object of the invention is to provide a method of restoring lapped panel metal roofs wherein an overlying, non-elastic coating, which can be economically applied, bonds to joint-covering, elastic strips and is returned from a somewhat parted condition, reached when the underlying panels move relatively, to abutting or near abutting position upon return of the temperature to the original value.

Still another object of the invention is to provide a restoration system which permits the restoration company to guarantee the coating against chipping, peeling, and rust-through for a period of as much as seven years, and to guarantee that the roof will be weather-tight for an additional five year period.

Still another object of the invention is to provide a restoration method which accomplishes restoration economically, provides a more durable roof, and can be accomplished with equipment of a non-complex nature by workmen who need not be highly skilled.

Other objects and advantages of the invention will become apparent with reference to the accompanying drawings and the accompanying descriptive matter.

DESCRIPTION OF THE PREFERRED EMBODIMENT

Figure 1:
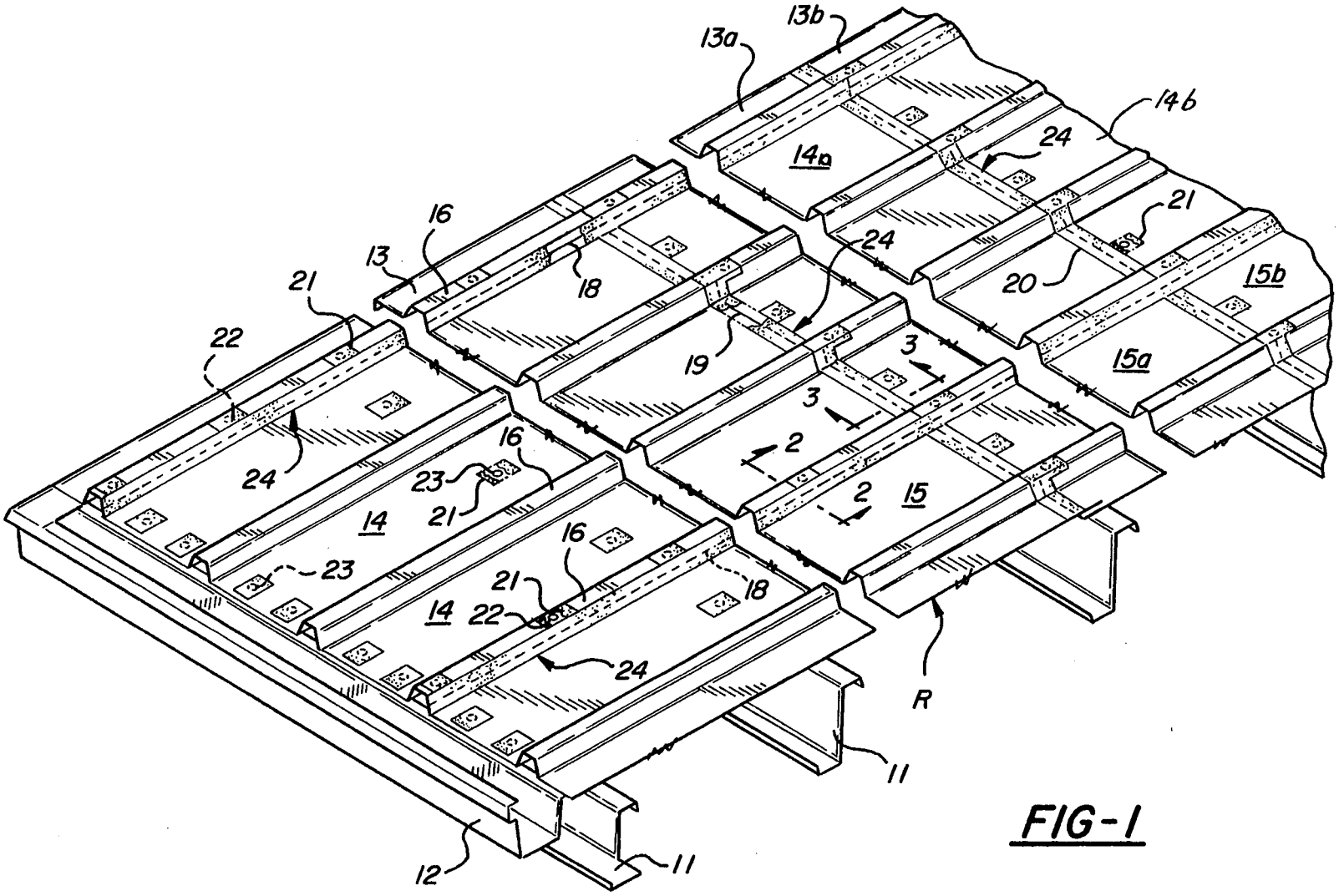
FIG. 1 is a schematic, perspective plan view with the various joints and fasteners shown as covered with elastic strips, prior to application of the overcoat which bonds to the strips and panels.

Referring now more particularly to the accompanying drawings, and particularly to FIG. 1 thereof, the underlying roof support structure for the roof R which is to be restored includes eave struts, generally designated 10, and purlins generally designated 11. Gutters 12 may be applied to the edges of the roof in the usual manner. Secured to the struts 10 and purlins 11 are a series of elongate, longitudinally extending, metal panels of the standing seam-type, which are identified at 13, 14, and 15. Longitudinal panels functioning as continuations of these panels 13–15 are designated at 13*a*, 14*a*, and 15*a*; and still further longitudinal panels forming further extensions are designated 13*b*, 14*b*, and 15*b*. The panels 13, 13*a*, and 13*b* are edge, standing seam panels with standing seam portions 16 and the intermediate panels 14, 14*a*, and 14*b* and 15, 15*a*, and 15*b* have the same standing seam portions 16. The terminal edges 18 of the standing seam portions 16 of panels 13, 13*a*, and 13*b* extend over the standing seam portions 16 on one edge of panels 14, 14*a*, and 14*b*, respectively, and the terminal edges of the opposite edge standing seam portions 16 of panels 14, 14*a*, and 14*b* extend over the standing seam portions 16 of one edge of panels 15, 15*a*, and 15*b*, respectively, to form lap joints at the overlapping junctures of the panels 13 and 14, 13*a* and 14*a*, 13*b* and 14*b*, 14 and 15, 14*a* and 15*a*, and 14*b* and 15*b*.

Also, the terminal end edges 19 of panels 13*a*, 14*a*, and 15*a* overlap the end edges of panels 13, 14, and 15 to form lap joints. Similarly, the overlapped end edges 19 of the panels 13*b*, 14*b*, and 15*b* overlap the ends of panels 13*a*, 14*a*, and 15*a* to form lap joints.

As will be noted, an elastic strip 21 is applied over all fasteners 22 and 23, after all fasteners have been tested with a torque wrench and those which are faulty, or have rusted out, have been replaced with oversized fasteners. Some of the fasteners 22 extend through the lapped standing seams of the panels. Other fasteners 23 are utilized to extend through other portions of the panels and into the underlying roof structure, i.e., the eaves struts or purlins, to assist in securing the panels in position, again after faulty or rusted fasteners have been replaced with new oversized fasteners.

Figure 2:
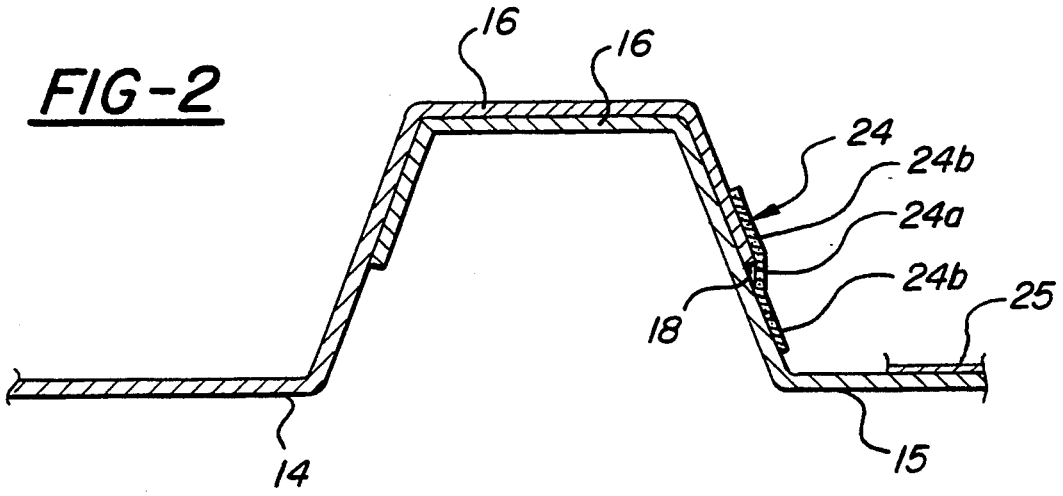
FIG. 2 is a transverse, fragmentary, cross-sectional view taken on the line 2—2 of FIG. 1.
Figure 3:
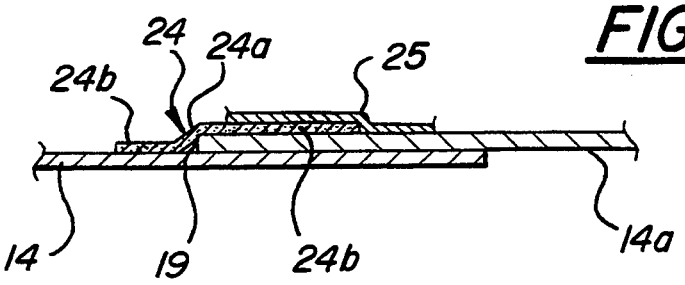
FIG. 3 is a similar view taken on the line 3—3 of FIG. 1.

As will be noted, all fasteners 22 and 23, in the restoration method which will be presently more explicitly described, are covered with elastic strips or sealants 21, which are tacky and bond to the adjoining metallic panels. Similarly, the edges 18 and 19 are covered with elongate two-inch wide elastic strips or sealants, generally designated 24, of the same character. The strips 24, when applied, span the lapped metal edges 18 and 19. Because the strips adhere to adjoining panel surfaces which are not in the same plane, those intermediate or bridging portions **24*a* of the strip which extend beyond the lapping edges 18 and 19, without immediately contacting the adjacent panel surface, are particularly free to stretch and will move with the panel edges when these edges move relatively with temperature-induced contraction and expansion of the panels and the underlying structure. In FIG. 2 the portion 24*a* is shown as somewhat stretched, while the edge portions 24*b* of the strips 24 remain firmly bonded to the bridged panels 14 and 15. In schematic FIG. 1, the strips 24** are shown as wider and covering the entire side of the standing seams.

One elastic strip which may be used is a butyl polymer rubber strip having a tacky contact surface which will bond to the underlying metal surfaces when pressed into position. It is believed that, at the time of vulcanization of the strip, the polymer rubber is cured to the extent that it is elastically solid, while retaining a surface tackiness. The strip is referred to by the marketer of the strip as a non-curing, polymer rubber strip. It is believed the product may be referenced generally as an isobutylene-isoprene type elastomer.

In order to be operative in the manner to be later described, such a rubber strip 24 should be stretchable at least 100% under the temperatures encountered without fracturing or losing its elasticity and adhesion, and preferably will have a minimum 200% such elongation. One strip which may be used has such an elongation of 1,000% at 77° F. and 400% at 32° F. and may be obtained from Adco Products, Inc. of Michigan Center, Mich., which is a subsidiary of Nalco Chemical Company, in two inch wide strips designated ET-117SP-100, and in four inch wide strips designated ET-118SP-100. In practice, the two inch wide strip, because of the elongation factor, is very satisfactory and much more economical.

Once the strips have been applied in the manner indicated in FIG. 1, an overcoating 25 is applied to the entire surface of the roof, after first washing the entire roof with a water stream, blowing it dry with a high pressure air stream to remove all loose particles, and then applying a rust stop primer to all rusted areas. The coating 25 is applied in a thickness of approximately 28 mils when wet and comprises an asphaltic base coating with aluminum paste incorporated therein to give it an aluminum color. In addition to the asphaltic base, the coating includes mineral spirits as a solvent. The solvent by weight is included in the nature of 57% of the wet coating, plus or minus 2%, which by volume is 42%, plus or minus 2%. When dried, the coating 25 will have a thickness in the nature of 6.9 mils and strongly adheres to the strips 24 and the roof panels.

In terms of chronology, the metal roof restoration system contemplates power wire-brushing the entire roof as a first step, before checking all fasteners and replacing all loose and missing fasteners with oversize fasteners. All lap edges 18 and 19 are covered with adherent strips 24 in the manner indicated and the ridge cap edges are also similarly covered, as are all fasteners and patch panels which may be used to repair broken corrugations and rusted-through areas. Any movement of the fasteners and patch panels is accommodated by the rubber strips 21 in this manner.

THE OPERATION

Figure 4:
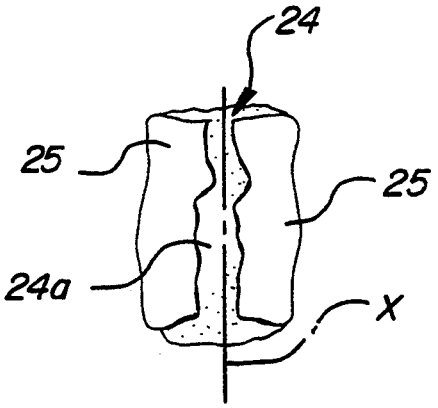
FIG. 4 is an enlarged fragmentary plan view showing the edges of the asphaltic overcoating parted as a result of temperature-induced panel movement, the chain line indicating the general returned position of the parted edges.

Once the roof has been restored in the manner indicated, it will, of course, be subjected to temperature-induced expansion and contraction of the underlying structure, as well as the roof panels themselves. Because the strips 24 are elastic, the strips stretch, particularly at the bridging sections **24*a*, when the panel edges 18 and 19 move without losing their adhesion as the rubber stretches. When the roof panels move apart, a cracking of the non-elastic asphaltic coating occurs as shown in FIG. 4, with the parted coating edges moving or riding with the rubber to which they are bonded. When permitted by temperature change to do so, they similarly ride the rubber and are returned to the abutting or near abutting relation, indicated by the line in FIG. 4**, as the elastic strips return to a less stretched or non-stretched condition.

With the system described in which the coating 25 moves with the strips 24, no leaks appear between the asphaltic coating and the underlying strip surface, even though the asphaltic coating needs to crack or part to accommodate extreme temperature differentials. When heated by the sun, the asphaltic coating 25 tends to repair itself because its edges have returned to abutting, or near abutting disposition.

It is to be understood that the embodiments described are exemplary of various forms of the invention only and that the invention is defined in the appended claims which contemplate various modifications with the spirit and scope of the invention.

I claim:

1. A method of restoring degenerated, no longer weather-tight or moisture-proof, standing seam and like lapped panel metal roofs incorporating adjacent panels having edges lying in different planes which overlap to form lapped edge joints wherein the terminal edge of one sheet is an exposed edge which extends over and overlies the edge of an adjacent panel to form a joint and wherein fasteners extend through said panels into a roof support structure, and fasteners extend through the lapped edges of said panels to secure them together, comprising the steps of:

(a) replacing any defective fasteners;

(b) applying flexible elongate elastic strips to span and overcover said exposed, lapping edges of the panels along their lengths, and adhering them to said panels forming the joint, the strips being stretchable at least 100% with temperature-induced movement of the panels;

(c) applying covering sealants over certain of said fasteners; and (d) applying a substantially non-elastic asphaltic coating over said sealants and roof panels which bonds to both said sealants and said roof panels and forms an overall outer cover for said roof, thereby permitting said coating to crack and with stretching of said strips at said joints to produce separated edges in said coating due to temperature induced panel edge movement, and the cracked and separated edges to return with said sealants to abutting or near abutting relation with temperature-induced reverse movement of said edges of the panels.

2. The method of claim 1 wherein said strips are synthetic rubber sealants with a tacky surface bonding to said panels and have an elasticity which permits stretching of the strips without loss of the adhesion of said adhesive.

3. The method of claim 1 wherein, prior to step (a), the roof is wire-brushed to remove the products of oxidation.

4. The method of claim 1 wherein said coating is asphalt based and capable of self repair with the application of heat from the sun.

5. The method of claim 1 wherein said sealants for the fasteners are of the same composition as said strips for the lapped edges of the panels.

6. The method of claim 1 wherein said strips include edge portions, disposed in different planes and adhered to different panels, and non-adhering edge-bridging portions free to expand with relative movement of said different panels.

7. The method of claim 3 wherein the step of claim 3 is followed by prime coating the roof panels with an alkyl base primer.

8. The method of claim 1 wherein said stretchability is at least two hundred percent.

9. The method of claim 2 wherein the sealants are non-curing butyl rubber strips.

* * * * *